United States Patent [19]

VanAuken

[11] 4,132,579

[45] Jan. 2, 1979

[54] GOLF SHAFT AND METHOD OF MAKING SAME

[75] Inventor: Richard L. VanAuken, 1000 Papau Rd., Sommerville, N.J. 08876

[73] Assignee: Exxon Research & Engineering Co., Florham Park, N.J.

[21] Appl. No.: 771,015

[22] Filed: Feb. 22, 1977

Related U.S. Application Data

[62] Division of Ser. No. 508,884, Sep. 24, 1974, Pat. No. 4,023,801.

[51] Int. Cl.[2] ..... B65H 81/00

[52] U.S. Cl. ..... 156/189; 156/192

[58] Field of Search ..... 156/187, 191, 192, 189; 273/80 R, 80 B, DIG. 7, DIG. 23; 428/902, 408

[56] References Cited

U.S. PATENT DOCUMENTS

| | | | |
|---|---|---|---|
| 3,166,319 | 1/1965 | Brilhart | 156/192 X |
| 3,457,962 | 7/1969 | Shobert | 273/80 R X |
| 3,691,000 | 9/1972 | Kalmin | 273/DIG. 7 UX |
| 3,700,535 | 10/1972 | McCoy et al. | 156/189 X |
| 3,813,541 | 4/1967 | Benkoczy et al. | 156/192 X |
| 4,000,896 | 1/1977 | Lauraitis | 273/80 R |

FOREIGN PATENT DOCUMENTS

| | | | |
|---|---|---|---|
| 2230491 | 12/1974 | France | 156/189 |
| 1261541 | 1/1972 | United Kingdom | 273/80 R |
| 1349906 | 4/1974 | United Kingdom | 273/80 R |
| 1351732 | 5/1974 | United Kingdom | 273/80 B |

*Primary Examiner*—David A. Simmons
*Attorney, Agent, or Firm*—Joseph J. Dvorak

[57] ABSTRACT

A novel golf shaft and its method of fabrication is disclosed. The shaft comprises a tapered, scrolled, oblong blank of thin laminated sheet material having alternating laminae of woven glass fabric and resin impregnated unidirectional graphite fibers. The fibers are arranged in a predetermined specific angle of orientation with respect to the longitudinal axis of the shaft.

5 Claims, 5 Drawing Figures

GOLF SHAFT AND METHOD OF MAKING SAME

This is a division, of application Ser. No. 508,884, filed Sept. 24, 1974, now U.S. Pat. No. 4,023,801.

BACKGROUND OF THE INVENTION

The present invention relates generally to golf club shafts and more particularly to a novel laminated golf club shaft and its method of manufacture.

There are numerous factors which affect the performance characteristics of golf shafts such as the weight and balance of the shaft, the flexibility of the shaft and the ability of the shaft to withstand shock. Additionally, of course, a shaft of optimum design must maintain its performance characteristics over a wide range of ambient weather conditions and even be resistant to moisture and other corrosive elements such as hand perspiration and the like.

In addition to the foregoing considerations, it is well known that there is a somewhat intangible, but nonetheless real and important, characteristic of a golf shaft referred to as the "feel," which has a very definite effect on the playability of the shaft as well as the commercial acceptance of the shaft.

A considerable amount of effort has been expended in the past to produce golf club shafts having the desired performance characteristics. Thus, golf club shafts have been made from wood, such as hickory, and from metals, such as steel and aluminum. The wooden shafts have the advantage of not transferring vibrational shocks to the player when the ball is struck during play. On the other hand, the wooden shafts suffer from the disadvantage that they are not easily matched into a complete set and they are very much subject to changes in climatic weather conditions. Metal shafts are not susceptible to variations in physical characteristics in response to climatic changes; however, tubular metal golf shafts transfer a great amount of the vibration to the player when the club head strikes the golf ball. Attempts have been made to remedy the deficiencies of the tubular golf shafts by coating the metal tube with a resin impregnated glass fiber and while the use of such resin impregnated glass fiber coatings on tubular shafts has a tendency to provide a dampening effect on the vibrations normally experienced, nonetheless such coatings have introduced other changes in the playing characteristic of the club. Consequently, there still remains a need for an improved golf shaft that will have the necessary shading in weight which will permit the player to attain greater driving range and control, and which can be accurately adjusted to provide a set of matched golf clubs each having the same "feel."

SUMMARY OF THE INVENTION

According to the present invention, an improved golf shaft comprises a scrolled, oblong blank of thin sheet material. The thin sheet material is a laminated material formed from at least two layers of resin impregnated unidirectional graphite fibers, each layer of resin impregnated graphite fiber being separated from the next resin impregnated layer by a woven glass fabric layer. The unidirectional graphite fibers are arranged at a predetermined angle with respect to the major axis of the oblong shaped blank. Thus, the unidirectional fibers in the first layer range generally from about 13° to about 26° with respect to the major axis of the oblong shaped layer, whereas in the second layer the unidirectional fibers are arranged at an angle ranging from about −13° to about −26°. Preferably the fibers in the second layer are of the same angle of orientation but of opposite sign of the fibers in the first layer. The angle of orientation of the fibers in the woven glass fabric layer or layers is between ±40° and ±50° with respect to the major axis of the oblong blank, and preferably ±45°.

The present invention also employs a novel concept in the manner in which a golf shaft is manufactured. This manufacturing technique and concept permits the complete tailoring of a golf shaft to have a predetermined desired torque and flex as will be appreciated upon a complete reading of this specification.

Basically, the shaft is made by cutting a thin sheet of resin impregnated unidirectional graphite fiber into a predetermined flat pattern in which the fibers are oriented with respect to the major axis of the pattern at a preselected angle ranging from about 13° to about 26°. Thereafter, the second layer of the impregnated graphite fiber sheet material is cut into the same predetermined flat pattern in a manner such that the graphite fibers are arranged at an angle ranging from about −13° to about −26° with respect to the major axis of the pattern. A fabric, such as glass cloth, is also cut to the same predetermined flat pattern in a manner such that the fibers in the glass cloth are oriented at an angle ranging from about ±40° to about ±50° with respect to the major axis of the pattern. An oblong blank of thin laminated material is then prepared by at least interposing a layer of glass fabric between two layers of resin impregnated graphite fibers. Preferably a second layer of glass fabric is placed adjacent to one of the graphite fiber layers to provide a laminate of alternating layers of glass fabric and graphite fibers. Next, the marginal strips of the laminate are attached to a mandrel having a given taper. The mandrel is rotated so as to wind the laminated material in the form of a tapered scroll. The predetermined pattern, of course, will be at least sufficiently wide to accommodate at least one complete turn around the mandrel and preferably will be sufficiently wide to accommodate a number of convolutions. Generally the number of convolutions will be the result of up to about 4 turns of the oblong blank around the mandrel. After wrapping the laminate material around the mandrel, the assembly is heated at temperatures in the range of from 100° to 180° C. causing the resin layers in the various convolutions to bond to each other. Thereafter the mandrel is removed leaving a tube of the hybrid material described herein.

Various color and texture variations of the finished shaft are possible by proper use of pigments in the resin materials and by use of paints or other cosmetic techniques well known in the art.

DETAILED DESCRIPTION OF THE INVENTION

Figure 1:
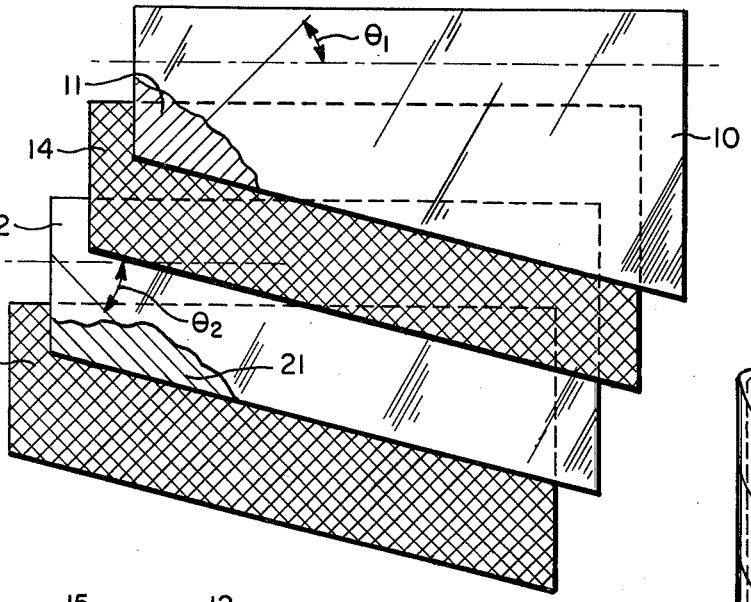
FIG. 1 is an isometric drawing partly in perspective and partly cut away showing the preferred number of layers of material used in forming the golf shaft of the present invention.

In referring now to the drawings, it should be noted that like reference characters designate corresponding parts throughout the several drawings and views.

Turning first to the isometric and partially perspective view of FIG. 1, the preferred four layers of material which go into forming the oblong blank of thin laminated material employed in forming the tubular golf shaft of the present invention are shown. As can be seen first layer 10 and a second layer 12 have a third layer 14 interposed between first layer 10 and second layer 12. First layer 10 is a sheet of unidirectional graphite fibers impregnated with a thermosetting resin in the shape of a predetermined pattern. First layer 10, for example, would have a thickness of about 0.007 to 0.010 inches and contain from about 50 to about 60 volume percent of graphite fibers in a thermoset resin matrix. Suitable thermoset resin materials include epoxy and polyester resins. Preferably, first layer 10 used in the present invention has from 54 to 58 volume percent graphite fibers in an epoxy resin matrix.

The epoxy resins or polyepoxides are well known condensation products of compounds containing oxirane rings with compounds containing hydroxyl groups or active hydrogen atoms such as amines, acids or acid aldehydes. The most common epoxy resin compounds are those of epichlorohydrin and Bis-phenol A and its homologs.

The polyester resins are polycondensation products of polybasic acids with polyhydric alcohols. Typical polyesters include polyterephthalates such as poly (ethylene terephthalate).

As is known in the art these thermoset resins also include modifying agents such as hardeners and the like. Forming such compositions is no part of the present invention. Indeed the preferred modified-epoxy resin impregnated graphite fibers are commercially available materials. For example, modified epoxy pre-impregnated graphite fibers are sold under the trade name Narmco 52-09 and Narmco 52-13 by Whitaker Corporation of California. Other commercial sources of resin pre-impregnated graphite fibers are known in the industry.

Returning to the drawings, as can be seen in the cutout of FIG. 1, the unidirectional graphite fibers 11 in the first layer 10 are oriented at a specific predetermined angle, $\theta_1$, with respect to the major axis of first layer 10. Second layer 12 is identical to the first layer 10 except that the unidirection graphite fibers 21 are oriented at a negative specific predetermined angle, $\theta_2$, with respect to the major axis of second layer 12, which angle preferably is of the same dimension and, of course, opposite sign of the angle of orientation of the fibers in first layer 10.

The woven glass fabric layers 14 and 15 each consist of a thin sheet of woven glass fabric having a thickness of about 0.001 to about 0.002 inches. Preferably a fiberglass fabric known in the trade as fiberglass scrim, is used. An especially useful fiberglass scrim is style 107 sold by Bulington Glass Fabrics Company, New York.

In fabricating the shaft the layers 10, 12, 14 and 15 are cut from stock material to the desired flat pattern. Each layer is cut to the same size and shape. The marginal edges along the minor axis of the oblong shaped material should be sufficiently wide to accommodate at least one complete turn about a mandrel. The precise dimensions of the end marginal edges will be determined, of course, by the number of convolutions of the material that is to be wound around the mandrel. The number of complete convolutions will range from about 1 to about 4. If only a single convolution of the material is to be wound around the mandrel, optionally layer 15 can be omitted.

Generally the major axis will be determined by the desired length of the shaft. In other words, the major axis preferably is equal in length to the longitudinal length of the ultimate shaft. In any event, as seen in FIG. 1, a first layer 10 of thermoset resin impregnated unidirectional graphite fibers is provided in which the unidirectional graphite fibers are oriented at a specific predetermined angle, $\theta_1$, with respect to the major axis of said layer; and, a second layer 12 of thermoset resin impregnated unidirectional graphite fibers also is provided; however, the unidirectional graphite fibers in second layer 12 are oriented at a negative specific predetermined angle, $\theta_2$, with respect to the major axis of said layer. The angle of orientation of the fibers in layer 10 will range generally between about 13° to about 26° and the angle of orientation of the fibers in layer 12 will range between about −13° to about −26°. Preferably the angle of orientation of the fibers in one layer is of the same dimension but opposite sign of the fibers in the other layer. Thus, the fibers preferably are arranged at an angle of from about ±13° to about ±26° with respect to the major axis of the pattern and hence the longitudinal axis of the shaft.

Figure 2:
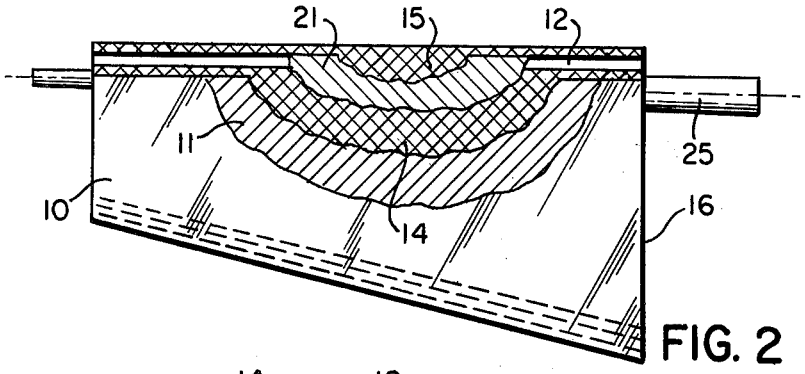
FIG. 2 illustrates a preliminary step in the method of the invention wherein an oblong blank of laminated material comprising alternating sheets of cloth fabric and unidirectional resin impregnated graphite fiber layers are arranged to be rolled upon a mandrel to form a tubular laminated golf club shaft.
Figure 4:
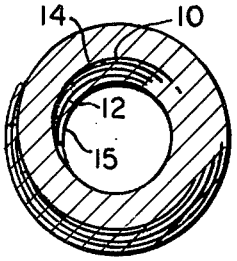
FIG. 4 is an enlarged radial cross-sectional view taken in the direction of arrows 3—3 of FIG. 2.

Layers 14 and 15 are cut from the fiberglass Scrim at a bias angle of from about ±40° to about ±50° and preferably at ±45° with respect to the major axis. Layer 14 is interposed between layers 10 and 12 and layer 15 is placed on either the top of layer 10 or the bottom of layer 12 to form an oblong blank of laminated material having alternating layers of graphite fiber and glass fiber. Preferably layers 10, 12, 14 and 15 are arranged one upon the other in a slightly overlapping relationship, as is shown in FIG. 2. The overlapping relationship provides for a smooth exterior surface on the finished shaft as is shown in FIG. 4.

In any event, the oblong laminated material 16 comprising layers 10, 12, 14 and 15 are wrapped around a mandrel 25, also shown in FIG. 2. The mandrel, of course, is selected to provide a predetermined desired taper in the shaft. Additionally, the mandrel can be cleaned and pre-treated with a suitable resin release material such as the commercially available silicone parting or release agents.

The oblong blank laminated material 16 can be held in place wrapped about mandrel 25 by any suitable means well known in the art. For example, cellophane tape can be used to hold the oblong blank laminated material 16 in place around the mandrel 25. Preferably, the oblong blank laminated material 16 is held in place around mandrel 25 by a wrapping of cellulose acetate tape or sheet material (not shown) which serves, in effect, as a mold which is subsequently removed as hereinafter described.

After wrapping the laminated oblong blank material 16 around the mandrel 25, the assembly is placed in an oven and heated to a temperature sufficient to cause a bonding of the separate layers and various convolutions to each other. The temperature at which the assembly is heated depends on a number of factors including the resin which is used to impregnate the graphite fibers. These temperatures are well known; typically for modified epoxy resin impregnated graphite fiber, the temperature will be in the range of about 100° C. to about 180° C. and preferably at about 140° C.

After heating the assembly to produce the necessary bonding of the individual layers 10, 12, 14 and 15 and the convolutions of laminated material into the desired tubular shape, the mandrel is removed.

If an external cellulose acetate wrapping film was used to hold the laminate 16 around the mandrel 25, this, too, is removed by suitable means such as sanding the surface of the shaft or dissolving the cellulose acetate in a suitable solvent. Preferably, the cellulose acetate surface film is removed by dissolution of the cellulose acetate in acetone.

Surface imperfections, if there are any, on the finished shaft can be removed by sanding, grinding or the like. For example, subjecting the shaft to a centerless grinding step after solvent removal of the cellulose acetate provides a completely uniform appearing exterior surface on the shaft.

Figure 3:
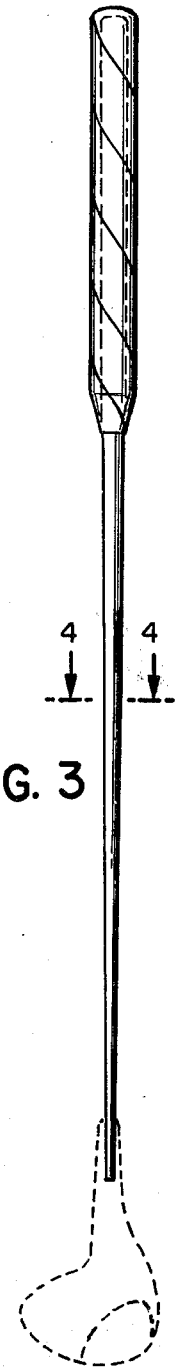
FIG. 3 illustrates in reduced scale a tapered laminated golf club shaft formed by the method of the present invention, designed for a hosel style golf club head.

Finally, the shaft can be fitted with a grip and club head such as suggested in FIG. 3. Optionally, the shaft can, prior to being fitted with the grip and club head, be painted to provide the desired appearance. Additionally, while FIG. 3 shows the shaft fitted in the hosel of a golf club head, over the hosel shaft designs are contemplated by the present invention.

By varying the angle at which the unidirectional graphite fibers are oriented in the first and second layers, a golf shaft can be tailored to have any one of the standard flexes: L, A, R, S, X and XX. Thus, for a shaft having an L-flex, the angle of orientation of the unidirectional fiber with respect to the major axis of the sheet material, in layers 10 and 12, is ±25°. In other words, if an angle of 25° is selected for layer 10, then the angle in layer 12 is −25°. Arranging the graphite fibers and glass fibers in the above-mentioned predetermined orientation is a very important feature of the golf shaft of this invention and its method of preparation since the thickness of each layer of sheet material and the number of convolutions of laminated material do not have to be altered to vary the flex and torque characteristics of a shaft; rather, from a given stock of layer material the angle at which each layer is cut determines the angle of orientation of fibers and hence the flex and torque characteristics of the shaft. This also assures continuity throughout the shaft and makes possible a stepless shaft that delivers more power.

Figure 5:
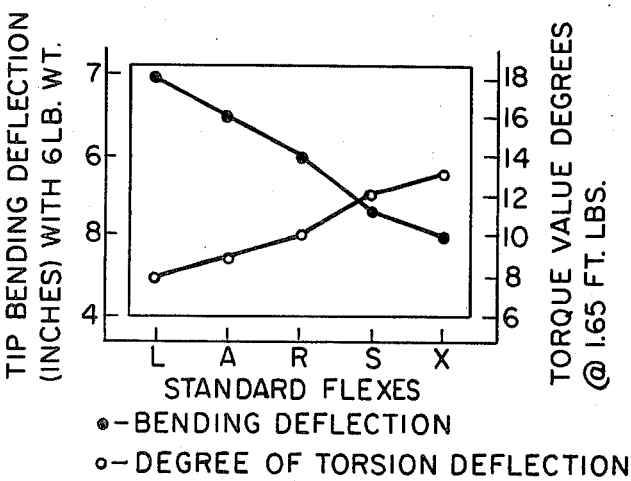
FIG. 5 is a graph showing the comparative flex and twist values of the graphite shaft pattern in accordance with the present invention.

As can be seen in the diagram of FIG. 5, the unique shaft of the present invention can be tailored not only to have a tip bending deflection between about 7 and about 5 inches but also to have a torque at 1.65 ft. lbs. of between about 8° and about 13°. The tip bending deflection was determined by standard industry techniques and on a Ken Smith Deflection Test Board sold by Ken Smith Co., Kansas City, Mo. The test consists of placing a shaft in a horizontal position and affixing it to the board 44 inches from the tip. A 6 pound weight is placed one inch from the tip and allowed to bend the shaft. The distance from the horizontal where the weight bends the shaft is measured to determine the amount of deflection.

The torsional deflection is determined by clamping the shaft in a horizontal position 40 inches from the tip of the shaft. A four jaw collet is clamped to the tip. This collet is attached to a rotating shaft that has a 9 inch diameter pulley attached. A weight is suspended from a cable attached to the pulley sufficient to apply a constant torque of 1.65 ft. lbs. A pointer on the rotating shaft indicates the degrees of shaft rotation under the torque force.

It has been discovered that by keeping the bending deflection and torsion deflection in the narrow range shown in FIG. 5, lateral shot dispersions for numerous players is substantially reduced.

Apparently because graphite composites have a low stretch or elongation factor compared with metals such as aluminum, steel or plastic material, the graphite shaft of the present invention has an exceptional recovery. In other words, when a golf club is swung, on a backswing, the shaft tends to bend backwards, and, on the downswing, the club head is behind the hands as they enter the hitting area. Then, the shaft begins to restore itself and the club head accelerates into the hitting area. This is generally referred to as the "club head recovery." Because the graphite fibers in the shaft of the present invention have a low stretch or elongation factor compared with conventional shaft materials, the shaft restores itself at a much higher rate. This results in a higher club head speed at the impact. Moreover, the club head does not slow down significantly after impact. This increase in club head speed means more energy at impact and that means more carry on drives.

What is claimed is:

1. A method of forming a tubular golf shaft having narrow range bending and torsional deflections from a sheet of unidirectional resin impregnated graphite fiber and a sheet of woven glass fabric comprising the steps of:

cutting said sheet of resin impregnated unidirectional graphite fiber to a predetermined flat pattern constituting a first layer having the fibers oriented at an angle ranging from about +13° to +26° with respect to the major axis of the predetermined flat pattern;

cutting said sheet of glass cloth to the same predetermined flat pattern and the same size as said resin impregnated fiber sheet and having the fibers of the cloth oriented at an angle ranging from about ±40° to about ±50° with respect to the major axis of the pattern, thereby forming a third layer;

cutting said resin impregnated unidirectional fiber sheet material to the same predetermined flat pattern and the same size of said first layer thereby forming a second layer, said second layer having the fibers oriented at an angle ranging between about −13° to about −26° with respect to the major axis of the predetermined flat pattern;

arranging said glass and fiber layers in alternating fashion with the glass layer interposed between the graphite fiber layers thereby forming an oblong blank of laminated material;

wrapping said oblong blank of laminated material around a mandrel;

heating said assembly of wrapped laminated material and mandrel to a temperature sufficient to cause the resin in the layers to fuse, thereafter allowing the fused material to cool and removing the mandrel.

2. The method of claim 1 wherein the assembly is heated at temperatures in the range of about 100° C. to about 180° C.

3. The method of claim 1 wherein the predetermined pattern is dimensioned sufficiently to form a number of convolutions of oblong blank material around said mandrel and wherein at least an additional glass layer is used.

4. The method of claim 3 wherein said glass and fiber layers are arranged in alternating fashion such that the longitudinal edge of each succeeding layer is positioned to overlap the longitudinal edge of the next preceding layer to provide a feathered edge, thereby providing for a smooth exterior surface when said laminate is wrapped around a mandrel.

5. The method of forming a fiber reinforced golf shaft having narrow range bending and torsional deflections comprising forming an oblong laminated sheet structure having a plurality of alternating laminae of woven glass fabric and sheets of resin impregnated unidirectional graphite fibers of the same shape and dimensions, the graphite fibers of each resin impregnated laminae being oriented at predetermined angles ranging from about 13° to about 26° with respect to the major axis of said oblong structure, the angle of orientation of each successive laminae of graphite fibers being the same but in opposite direction, the woven glass fabric of each glass fabric laminae being oriented at an angle of between ±40° to ±50° with respect to the major axis of said oblong structure and interposed between graphite fiber layers; each succeeding layer in said laminate being positioned in overlapping relationship to the next preceding layer to provide a feathered edge along the lengthwise edge of the oblong structure; wrapping said laminated structure in the form of a tapered scroll around a mandrel; and, thereafter heating said tapered scroll to a temperature in the range of about 100° C. to about 180° C., thereafter allowing the shaft to cool and removing the mandrel.

* * * * *